US009844286B2

(12) United States Patent
Merkurieff

(10) Patent No.: US 9,844,286 B2
(45) Date of Patent: Dec. 19, 2017

(54) MULTI-USE CAMPING TOOL

(71) Applicant: Merkwares, LLC, Sandy, UT (US)

(72) Inventor: Mikhail Eugene Merkurieff, Eagle Mountain, UT (US)

(73) Assignee: MERKWARES, LLC, Sandy, UT (US)

( * ) Notice: Subject to any disclaimer, the term of this patent is extended or adjusted under 35 U.S.C. 154(b) by 0 days.

(21) Appl. No.: 15/223,873

(22) Filed: Jul. 29, 2016

(65) Prior Publication Data

US 2017/0027353 A1 Feb. 2, 2017

Related U.S. Application Data

(60) Provisional application No. 62/198,559, filed on Jul. 29, 2015.

(51) Int. Cl.

| | |
|---|---|
| ***B25B 7/00*** | (2006.01) |
| ***B25B 9/00*** | (2006.01) |
| ***A47G 21/06*** | (2006.01) |
| ***A47G 21/10*** | (2006.01) |

(52) U.S. Cl.

CPC ..... *A47G 21/06* (2013.01); *A47G 21/10* (2013.01)

(58) Field of Classification Search

CPC ..... A47G 21/06; A47G 21/02; A47G 21/10; B65G 7/12

See application file for complete search history.

(56) References Cited

U.S. PATENT DOCUMENTS

| | | | | |
|---|---|---|---|---|
| D396,612 | S * | 8/1998 | Lillelund | D7/686 |
| 8,002,320 | B2 * | 8/2011 | Bowser | A47G 21/10 29/268 |
| D758,147 | S * | 6/2016 | Schuler | D7/686 |
| 2003/0118858 | A1 * | 6/2003 | Kushida | A47G 21/00 428/627 |
| 2009/0167040 | A1 * | 7/2009 | Tong | A47G 21/103 294/99.2 |
| 2012/0011727 | A1 * | 1/2012 | Yang | A47G 21/10 30/150 |
| 2014/0375071 | A1 * | 12/2014 | Audet | A47J 43/283 294/99.2 |

* cited by examiner

*Primary Examiner* — Stephen Vu
(74) *Attorney, Agent, or Firm* — Workman Nydegger

(57) ABSTRACT

In one example, a multi-use tool includes a first portion that includes a first utensil, and a second portion that includes a second utensil. A connection mechanism is provided that enables the first utensil and second utensil to be releasably attached to each other in a first configuration in which the first utensil and second utensil collectively form a set of tongs.

18 Claims, 12 Drawing Sheets

MULTI-USE CAMPING TOOL

RELATED APPLICATIONS

This application claims priority to, and the benefit of, U.S. Provisional Patent Application Ser. 62/198,559, entitled MULTI-USE CAMPING TOOL, filed Jul. 29, 2015. The aforementioned application is incorporated herein in its entirety by this reference.

BACKGROUND

The present disclosure is generally concerned with hand tools and implements. More specifically, at least some of the disclosed embodiments concern a re-configurable tool with multiple portions that can be used independently of each other, and which can also be releasably attached to each other in various ways so as to form one or more other tools.

BRIEF SUMMARY OF SOME ASPECTS OF THE DISCLOSURE

It should be noted that the embodiments disclosed herein do not constitute an exhaustive summary of all possible embodiments, nor does this brief summary constitute an exhaustive list of all aspects of any particular embodiment (s). Rather, this brief summary simply presents selected aspects of some example embodiments. It should be noted that nothing herein should be construed as constituting an essential or indispensable element of any invention or embodiment. Rather, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular technical effect(s) or solution(s).

A. Example Elements of A Multi-Use Tool

Disclosed embodiments are generally concerned with multi-use hand tools and implements. Embodiments of a multi-use tool within the scope of this disclosure may include any one or more of the following elements, and features of elements, in any combination: a tool having first and second portions that are independently functional and which can be releasably attached to each other; a tool having first and second portions that are independently functional and which can be releasably attached to each other by way of a connection mechanism comprised of respective elements of the first and second portions; a tool having first and second portions that can be releasably attached to each other to define one or more tool configurations; a tool having first and second portions that can be releasably attached to each other to define a pair of tongs; a tool having a first portion, in the form of a fork or spoon, and a second portion that can be releasably attached to the first portion to define one or more tool configurations; and, a tool having a first portion in the form of a fork and a second portion in the form of a spoon, where the two portions can be releasably attached to each other to define one or more tool configurations.

B. Example Embodiments of a Multi-Use Tool

Following is a non-exclusive list of embodiments within the scope of the invention. It should be understood that aspects of the various embodiments may be combined in other ways to form still further embodiments.

In a first example embodiment, a tool includes first and second portions that are independently functional and which can be releasably attached to each other.

In a second example embodiment, a tool includes first and second portions that are independently functional and which can be releasably attached to each other by way of a connection mechanism comprised of respective elements of the first and second portions.

In a third example embodiment, a tool includes first and second portions that can be releasably attached to each other to form one or more tool configurations.

In a fourth example embodiment, a tool includes first and second portions that can be releasably attached to each other to form a pair of tongs.

In a fifth example embodiment, a tool includes a first portion, in the form of a fork or spoon, and also includes a second portion that can be releasably attached to each other to form one or more tool configurations.

In a sixth example embodiment, a tool includes a first portion in the form of a fork and a second portion in the form of a spoon, where the two portions can be releasably attached to each other to form one or more tool configurations.

In a seventh example embodiment, a tool includes a first portion in the form of a fork and a second portion in the form of a spoon, where the two portions can be releasably attached to each other to define one or more tool configurations, and the two portions are releasably attached such that the portions can rotate relative to each other and can be locked into one or more orientations relative to each other.

In an eighth example embodiment, a tool includes a first portion in the form of a fork and a second portion in the form of a spoon, where the two portions can be releasably attached to each other to form a pair of tongs.

In a ninth example embodiment, any of the aforementioned example embodiments can be assembled together, and reconfigured to define one or more tool configurations, without the need for any separate fasteners.

In a tenth example embodiment, a tool according to any of the aforementioned embodiments consists of two portions, specifically, a fork and a spoon.

C. Further Aspects of Some Example Embodiments

As will be apparent from the present disclosure, one or more embodiments of the invention can provide one or more advantageous and unexpected effects, in any combination, some examples of which are set forth below. It should be noted that such effects are neither intended, nor should be construed, to limit the scope of the claimed invention in any way.

For example, one or more embodiments of the invention may be advantageous inasmuch as they enable a user to carry a single assembly that includes multiple tool portions, each having a different respective function. As well, embodiments of the invention may be advantageous insofar as they enable a user to define further tools with other functions, by manipulating the disposition of the tool portions relative to each other.

BRIEF DESCRIPTION OF THE DRAWINGS

The appended drawings contain figures of some example embodiments to further clarify various aspects of the present disclosure. It will be appreciated that these drawings depict only some embodiments of the disclosure and are not intended to limit its scope in any way. The disclosure will be described and explained with additional specificity and detail through the use of the accompanying drawings in which.

DETAILED DESCRIPTION OF SOME EXAMPLE EMBODIMENTS

Figure 1:
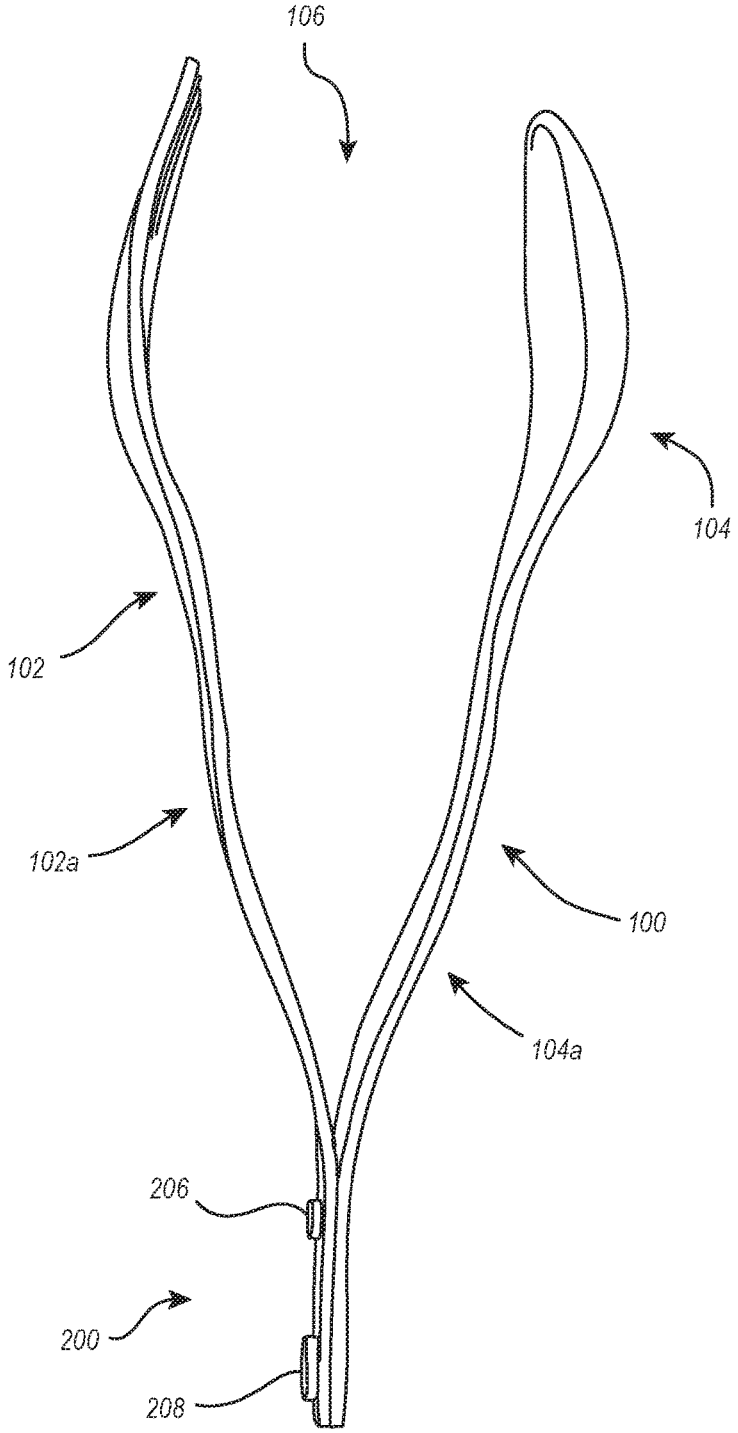
FIG. 1 is a side view of an example multi-use tool with two portions connected to each other in one example configuration.

The present disclosure is generally concerned with hand tools and implements. More specifically, at least some of the disclosed embodiments concern a re-configurable tool with multiple portions that can be used independently of each other, and which can also be releasably attached to each other in various ways so as to form one or more other tools. In one specific example embodiment, the tool is in the form of a camping tool that includes a fork portion and a spoon portion that can be releasably connected to each other in a plurality of different ways.

In another example embodiment, the tool includes two fork portions, and in yet another example embodiment, the tool includes two spoon portions. Still other example embodiments include three, or more, portions, any one or more of which can be a fork, or spoon, although that is not required. Embodiments with three or more portions can employ multiple instances of the connection mechanism disclosed herein, although that is not necessarily required and other connection mechanisms could alternatively be used.

D. General Aspects of Some Example Embodiments

In general, multi-use tools and associated portions disclosed herein, can be constructed with a variety of different materials. Examples of such materials include, but are not limited to, plastics, fiberglass, metal alloys and metals such as steel, aluminum and titanium, rubber, wood, carbon composites, and combinations of any of the foregoing. Where one or more metals are employed, they can be forged, stamped or otherwise formed to assume a desired shape and configuration. Plastic elements can be injection molded or otherwise formed. Part, or all, of the multi-use tool can also be made of biodegradable material(s). In some embodiments, one, some, or all portions of the tool can be made of a single piece of material.

Surface treatments and textures may also be applied to portions of the multi-use tool. For example, the handles can include a texture or pattern, which can be created with a blow-molding or other process.

E. Structural and Operational Aspects of a Some Example Embodiments

Directing attention now to FIGS. 1-11, details are provided concerning a multi-use tool, one example of which is denoted generally at 100. In the illustrated examples, the multi-use tool 100 includes first and second portions 102 and 104, although, in other embodiments, more than two portions may be included. In at least some embodiments, the first portion 102 may take the form of a fork, while the second portion 104 may take the form of a spoon.

As shown collectively by the Figures, the first portion 102 and second portion 104 can assume a variety of different dispositions relative to each other. For example, FIGS. 1-3 disclose an arrangement where the first portion 102 is in the form of a fork and the second portion 104 is in the form of a spoon. Each of the portions 102 and 104 includes a respective bend 102*a* and 104*a* so that when the portions 102 and 104 are arranged as shown in FIGS. 1-3, a space 106 is defined between the ends of the two portions 102 and 104.

In the illustrated example, the bends 102*a* and 104*a* are located generally near the middle of the portions 102 and 104 respectively. However, this configuration is not required and the bends 102*a* and/or 104*a* can be located elsewhere in the portions 102 and 104, respectively. For example, in one alternative embodiment, the bends 102*a* and 104*a* can be located relatively closer to the ends of portions 102 and 104 where those portions connect together. As well, the bends 102*a* and/or 104*a* can be relatively more, or less, pronounced than indicated in the illustrated example.

Figure 2:
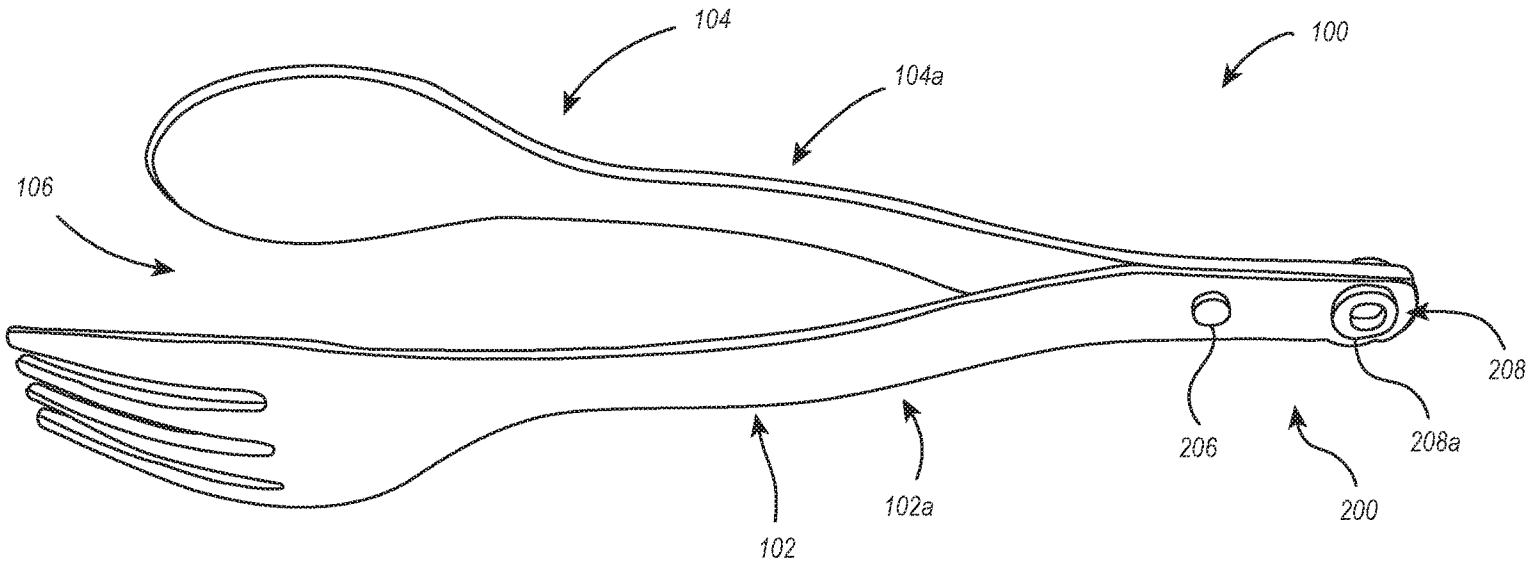
FIG. 2 is a top perspective view of the embodiment of FIG. 1, and shows first and second tool portions in one example arrangement, relative to each other.
Figure 3:
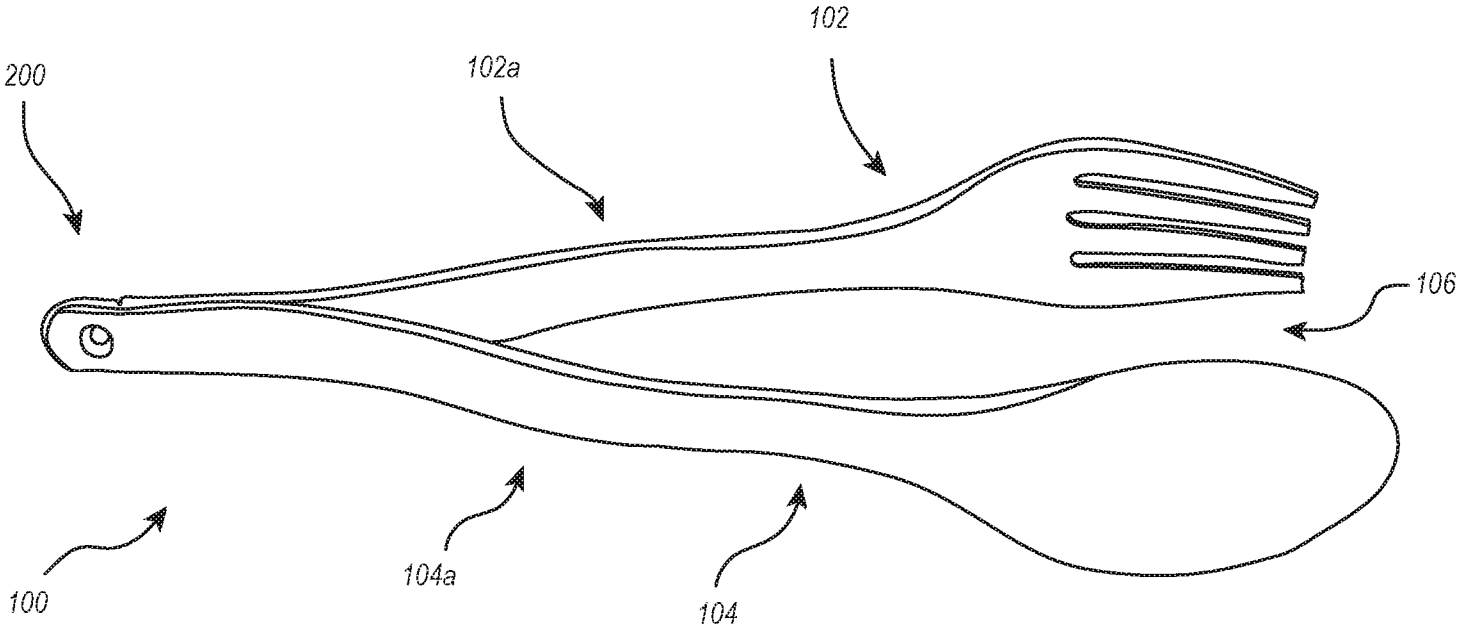
FIG. 3 is a bottom perspective view of the embodiment of FIG. 1, and shows first and second tool portions in one example arrangement, relative to each other.

Because one or both of the portions 102 and 104 may be made of a material, and/or have a configuration, that can be elastically deformed, the example configuration and arrangement of the portions 102 and 104 shown in FIGS. 1-3 forms a set of tongs in which the portions 102 and 104 can be squeezed together by a user to grasp an item, and then allowed to move apart from each other so as to release the item. Thus, one or both of the portions 102 and 104 can be selectively elastically deformed by a user, moving between a deformed state and a partly, or completely, undeformed state (as shown in FIGS. 1-3), such that the two portions 102 and 104 collectively operate as a set of tongs that can be used to selectively grasp and release an item.

In one alternative embodiment, both of portions 102 and 104 are spoons, and in another embodiment, both of portions 102 and 104 are forks. In another embodiment, one or both portions 102 and 104 may take the form of what is sometimes referred to as a spork, namely, a spoon configuration that includes tines like those found in a fork. In yet other embodiments, neither of the portions 102 and 104 is a fork, or a spoon. For example, one or both of the portions 102 and 104 can have a generally flat shape at the end, as in the case of a spatula, or knife, for example. The flat portion may, but need not, have one or more openings or holes in it.

More generally, any configuration of portions 102 and 104 can be employed and, in some embodiments, the portions 102 and 104 are substantially similar to each other in their configuration, as in the example where both portions 102 and 104 are forks. In other embodiments, the portions 102 and 104 are substantially different from each other in their configurations, such as in the example of FIGS. 1-3. As well, portions 102 and 104 can be substantially similar, or identical, to each other in terms of their overall size and configuration except insofar as one portion terminates in a spoon and the other portion terminates in a fork, as disclosed in FIG. 4 for example.

Figure 4:
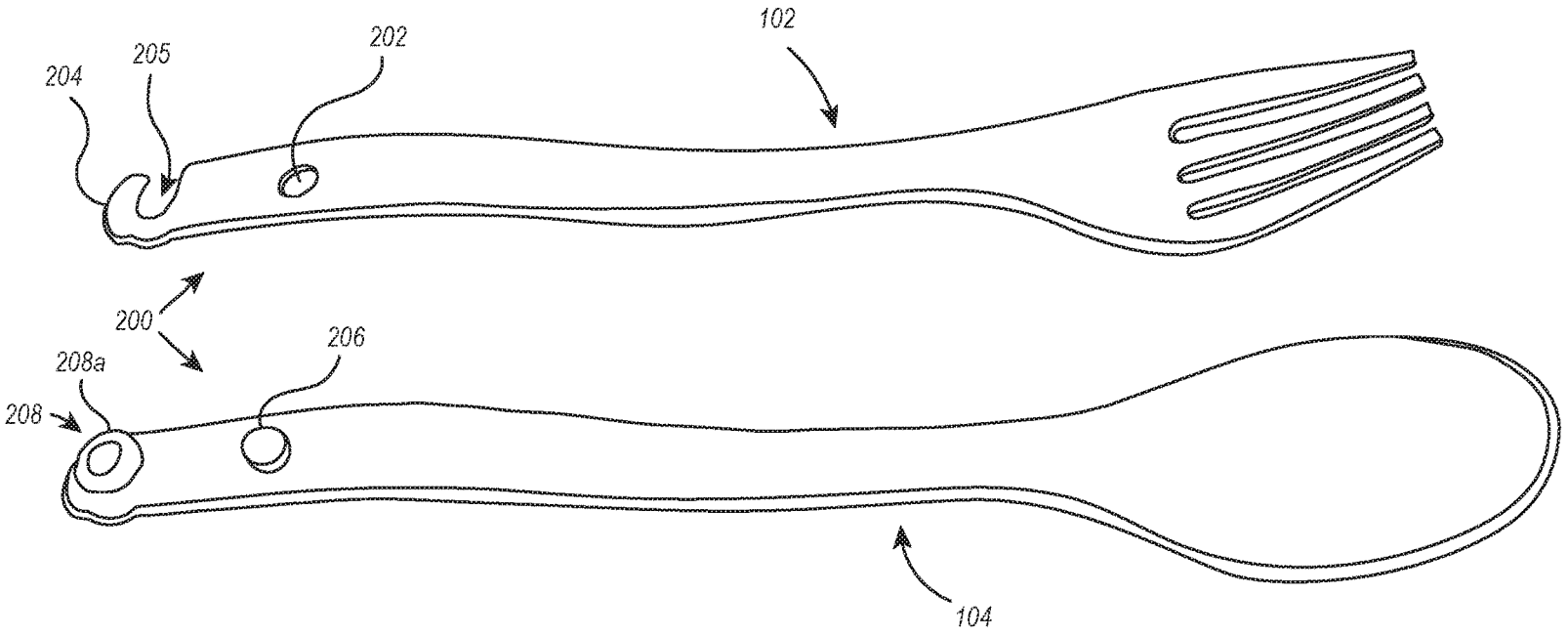
FIG. 4 is a top perspective view showing two tool portions separated from each other.

As noted elsewhere herein, and shown in FIG. 4 for example, the portions 102 and 104 can be removably attached to each other so that they can be separated if desired. As well, the portions 102 and 104 can be oriented, relative to each other in a variety of different ways when they are connected to each other. This can be seen, for example, by comparing the arrangement of portions 102 and 104, relative to each other, shown in FIG. 3 (portions 102 and 104 spaced apart from each other in a tong configuration), with the arrangement of portions 102 and 104, relative to each other, shown in FIG. 7 (portions 102 and 104 are nested with each other).

In at least some embodiments, the ability to remove portions 102 and 104 from each other, and reorient portions 102 and 104 relative to each other, is enabled by a way of a connection mechanism, one example of which is denoted at 200 in the Figures. The connection mechanism 200 is one example structural implementation of a means for releasably connecting first and second portions of a multi-use tool. Such a means may also enable the portions 102 and 104 to be releasably locked into one or more positions relative to each other. Of course, any other structure(s) of comparable functionality could alternatively be employed, and the scope of the invention is not limited to the example connection mechanism 200.

Figure 5:
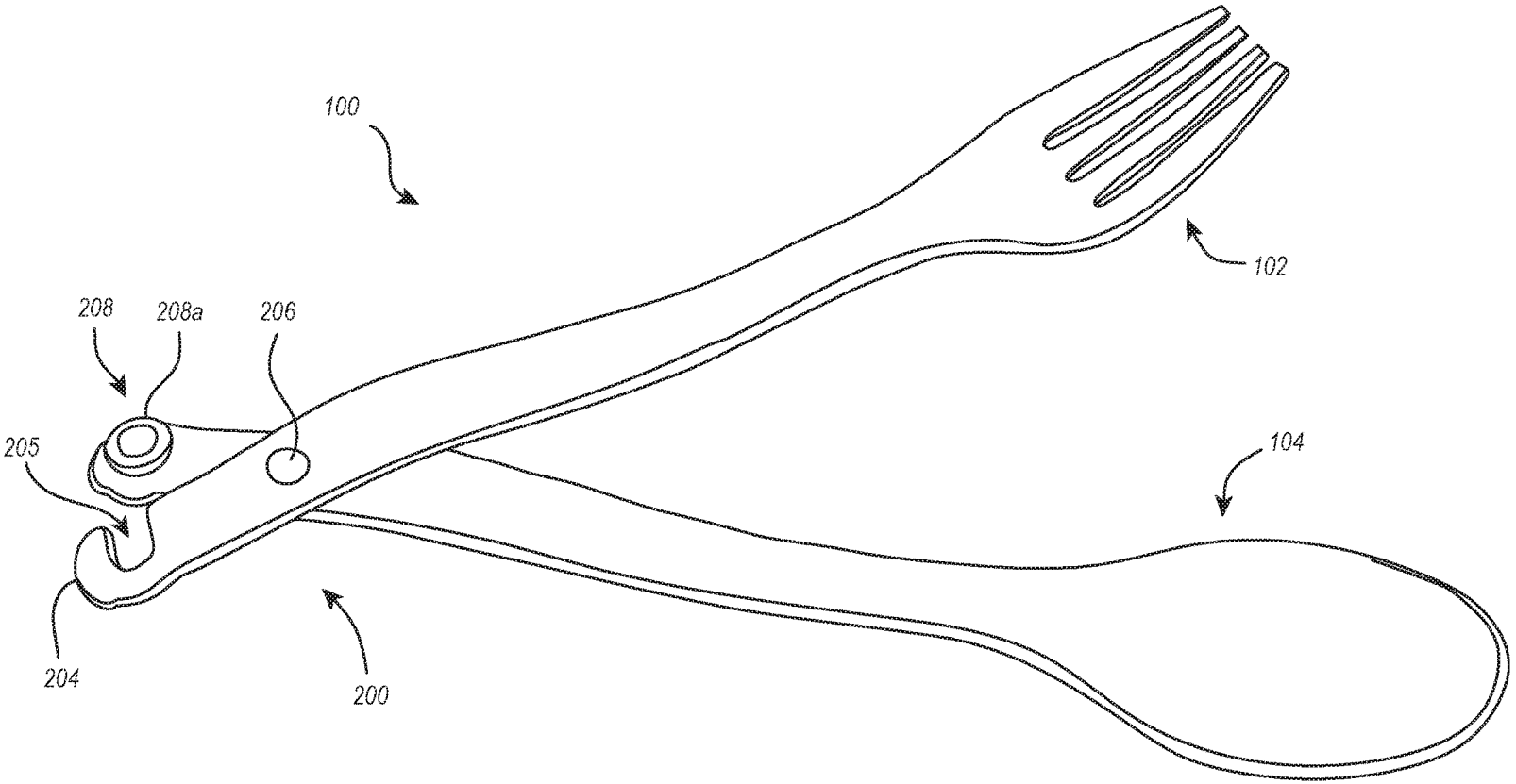
FIG. 5 is a top perspective view showing two tool portions connected to each other.
Figure 6:
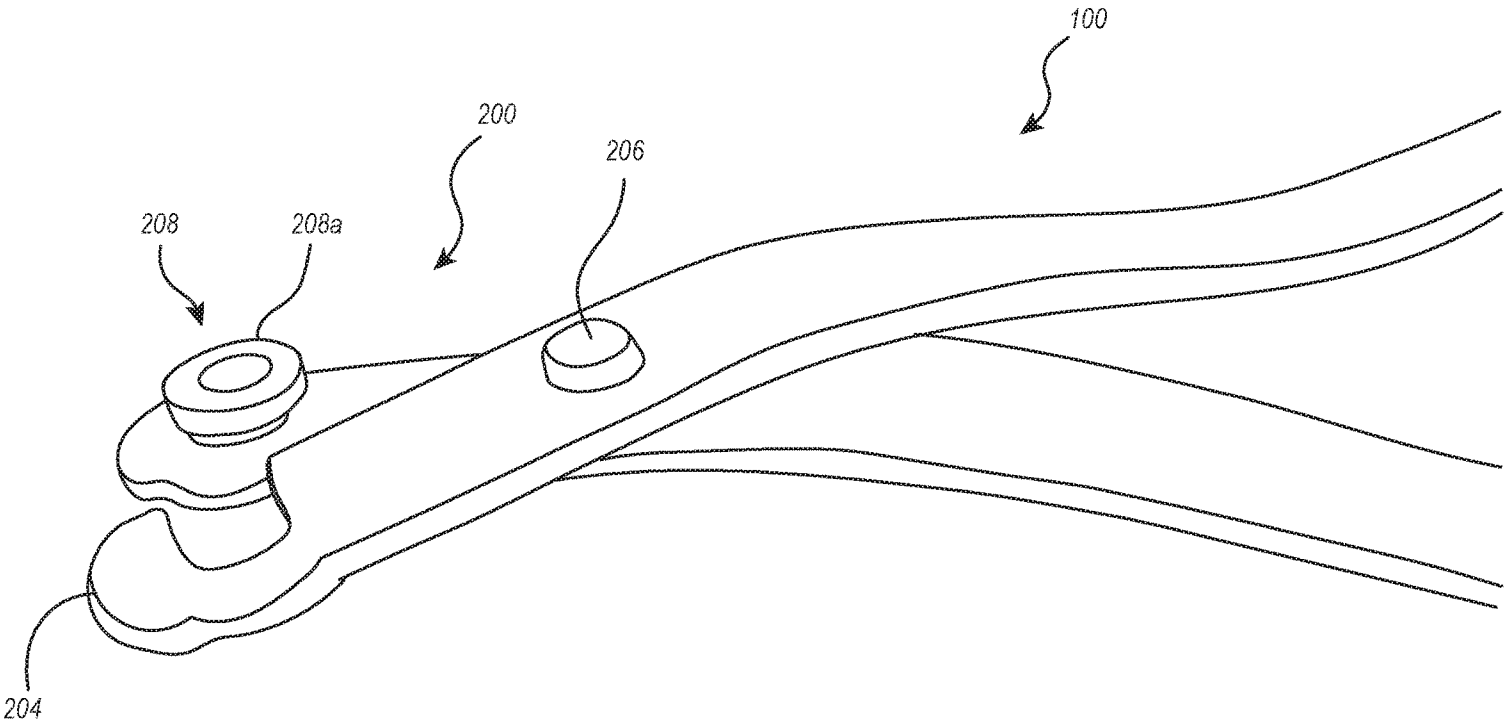
FIG. 6 is a detail view of aspects of a connection mechanism that enables two different portions to be releasably connected to each other.

As best shown in FIGS. 4-6, one useful aspect of at least some embodiments of the connection mechanism 200 is that it may consist entirely of respective elements of each of the first and second portions 102 and 104. These elements may be integrally formed with the respective portion 102 or 104 with which they are associated. As such, in these example embodiments, there are no discrete elements of the connection mechanism 200 that can be misplaced or lost. That is, as long as both portions 102 and 104 are available to the user, no other elements, such as fasteners for example, are required to enable those portions to be manipulated as shown in the Figures and disclosed herein. As such, some embodiments of the connection mechanism 200 may be referred to as fastenerless in nature. It should be noted that the way in which the various portions of the connection mechanism 200 are allocated between the first and second portions 102 and 104 is presented only by way of example and, in other embodiments, the first and second portions 102 and 104 may include additional, or alternative, elements of the connection mechanism 200.

While some embodiments advantageously eliminate the need for separate fasteners to releasably connect the first and second portions 102 and 104 together, it can be useful in other embodiments to employ one or more fasteners. Thus, yet other embodiments can employ a fastener to releasably connect the first and second portions 102 and 104 together. Such fasteners include, for example, screws and bolts.

With particular reference now to FIG. 4, the example connection mechanism 200 may include a pivot hole 202 and a hook 204, both of which may be integral elements of the portion 102 or, alternatively, the portion 104. The hook 204, which can also be referred to herein as a 'bail hook,' may define a slot 205. The pivot hole 202 is configured and arranged to releasably receive a corresponding pin 206, which may be an integral element of the portion 104 or, alternatively, the portion 102. In another example embodiment, the pin 206 can be a separate element that is inserted in the portion 104 at the time of manufacture. When the pin 206 is received in the pivot hole 202, as shown in FIG. 6 for example, the portions 102 and 104 are rotatable relative to each other about an axis defined by the pin 206 and pivot hole 202.

Figure 7:
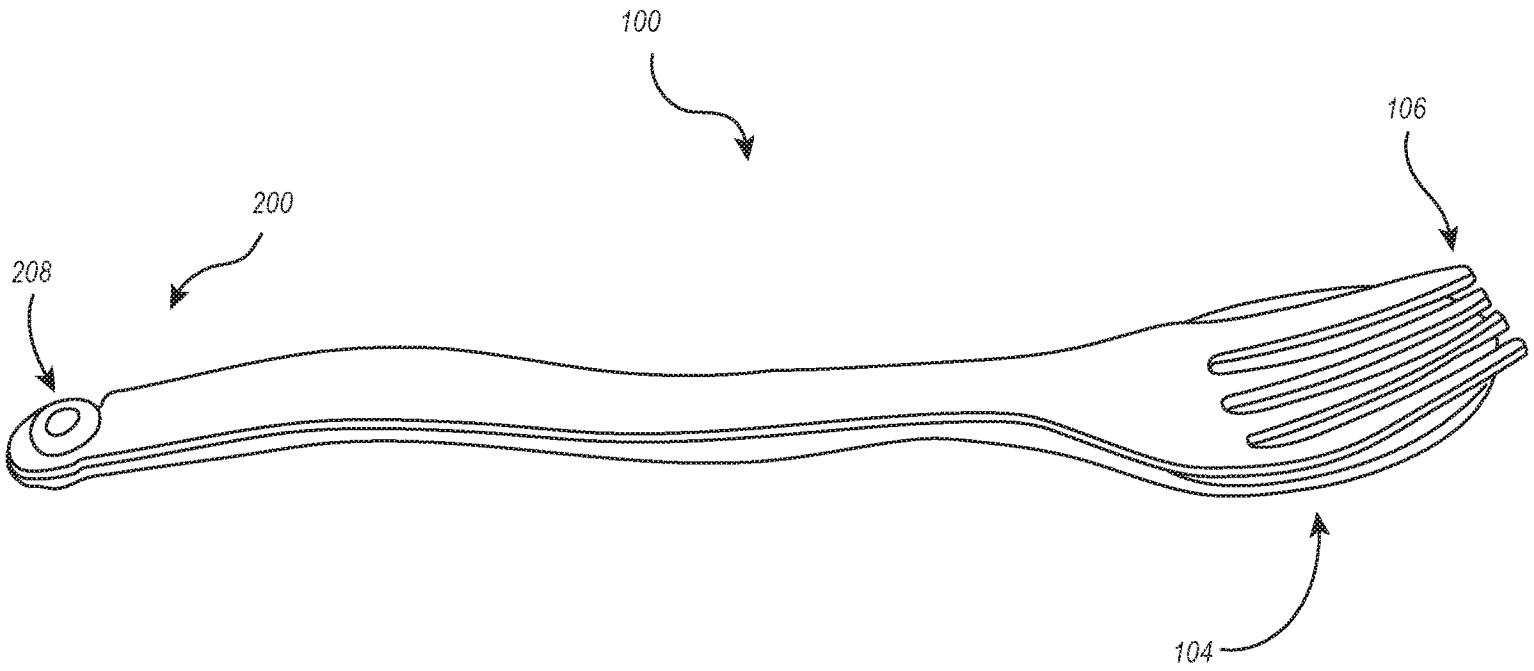
FIG. 7 is a perspective view showing first and second tool portions in one example arrangement, relative to each other.
Figure 8:
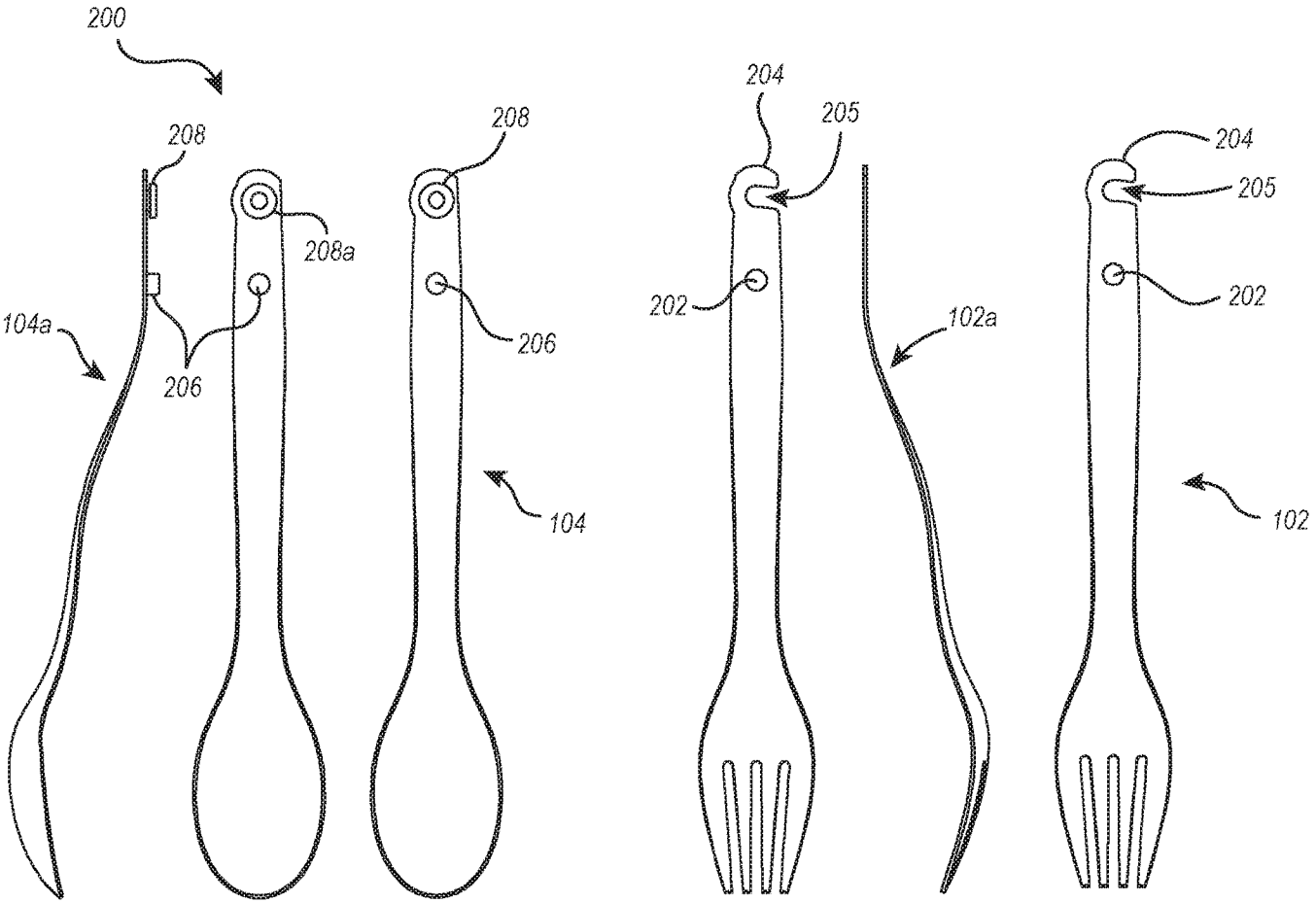
FIG. 8 includes various top and side views of various portions that can be included in embodiments of the multi-use tool.

If desired, the positions of the portions 102 and 104 can be locked relative to each other, as shown in FIGS. 3 and 7. To this end, the connection mechanism 200 further includes a locking pin 208, which may also be referred to in some Figures as a 'locking lug,' configured and arranged to be releasably engaged by the hook 204, as shown in FIGS. 2 and 7 for example. The locking pin 208 and hook 204 can be configured and arranged such that the portions 102 and 104 can be locked to each other in a particular orientation relative to each other regardless of whether, for example, the configuration of FIG. 2 is desired, or the configuration of FIG. 7 is desired.

The diameter of the locking pin 208 and the width of the slot 205 may be substantially the same so that the locking pin 208 and hook 204 can readily engage with, and disengage from, each other. However, some measure of resistance to disengagement of the locking pin 208 and hook 204 may be desirable in order to provide assurance that the portions 102 and 104 will remain in a desired orientation relative to each other until such time as a user decides to modify that orientation. In at least some embodiments, this resistance can be obtained by configuring the portion 102 and/or portion 104 so that some elastic deformation of one or both portions 102 and 104 is required in order for the hook 204 to fully engage the locking pin 208, and/or in order for the hook 204 to be disengaged from the locking pin 208.

By way of illustration, the portions 102 and/or 104 may be configured so that the hook 204 must be depressed slightly downward in order for the hook 204 to slip underneath a retention flange **208*a* of the locking pin 208. This slight depression or elastic deformation of the hook 204 thus enables the hook 204 to act like a spring and exert an upward retention force on the underside of the retention flange 208*a* so that the hook 204 and locking pin 208** tend to resist separation from each other.

Other mechanisms can alternatively be employed to help ensure that the hook 204 cannot separate too easily from the locking pin 208. For example, the locking pin 208 may have a slightly larger diameter than the width of the slot 205 of the hook 204.

As suggested in FIGS. 2 and 7, for example, a configuration change can be effected simply by separating the portions 102 and 104 from each other, orienting portion 102 in the desired fashion relative to portion 104 (or vice versa), and then reconnecting the portions 102 and 104 together, that is, so that portion 102 either nests with portion 104 (FIG. 7), or is spaced apart from portion 104 (FIG. 2). More specifically, a user can align the pin 206 with the pivot hole 202 and then extend the pin 206 through the pivot hole 202 until further movement of the pin 206 is no longer possible. Once the pin 206 is thus positioned in the pivot hole 202, the portion 102 and/or portion 104 can be rotated until the hook 204 is fully engaged with the locking pin 208.

Of course, the portions 102 and 104 can be separated from each other and used by a user to implement their different respective functions, for example, the functions of a fork and a spoon. In this example, the portions 102 and 104 can later be reconnected to each other, if desired.

Figure 9:
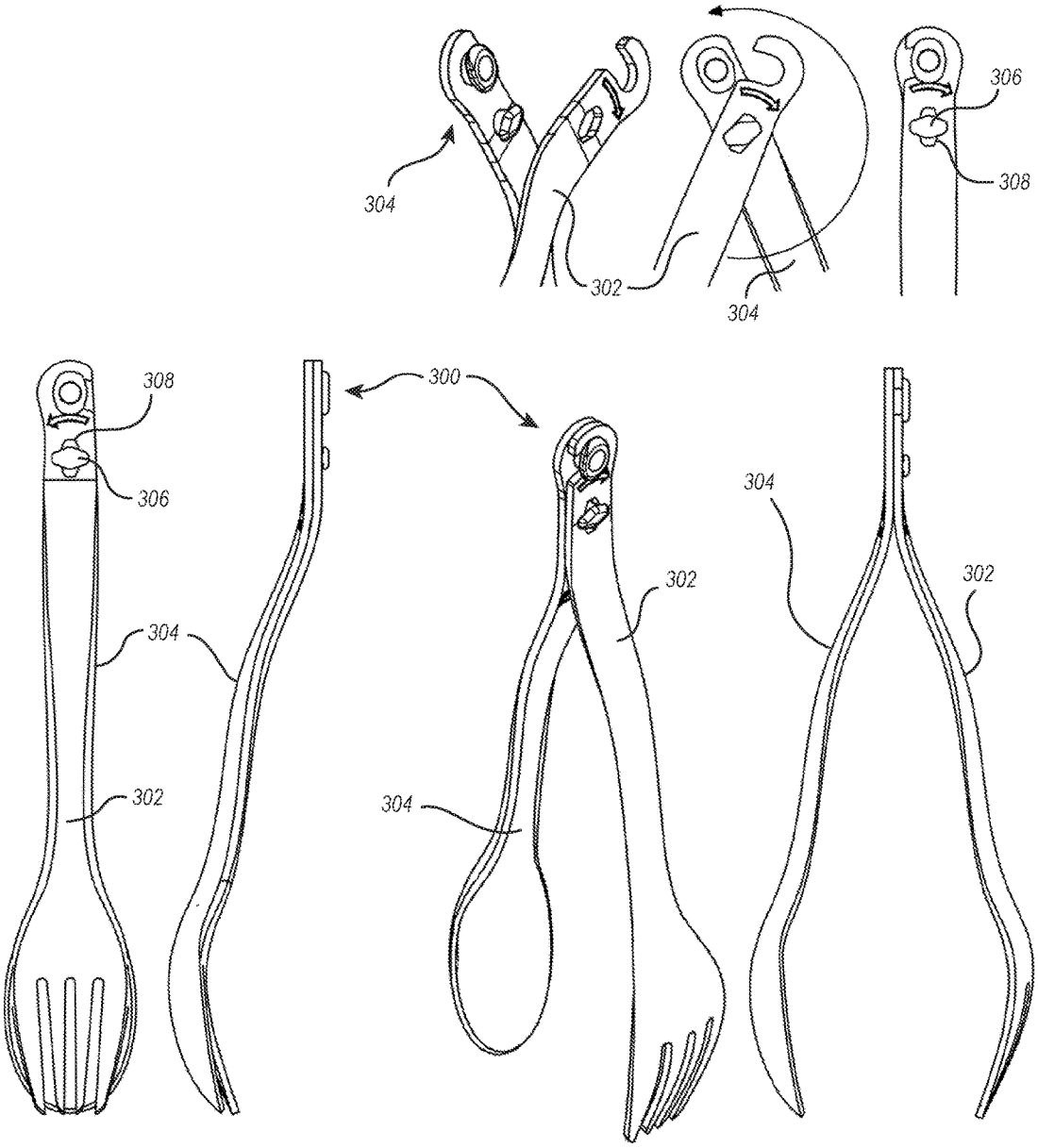
FIG. 9 discloses a configuration of first and second tool portions in the form of a fork and spoon, respectively, connected to each other to form tongs.
Figure 10:
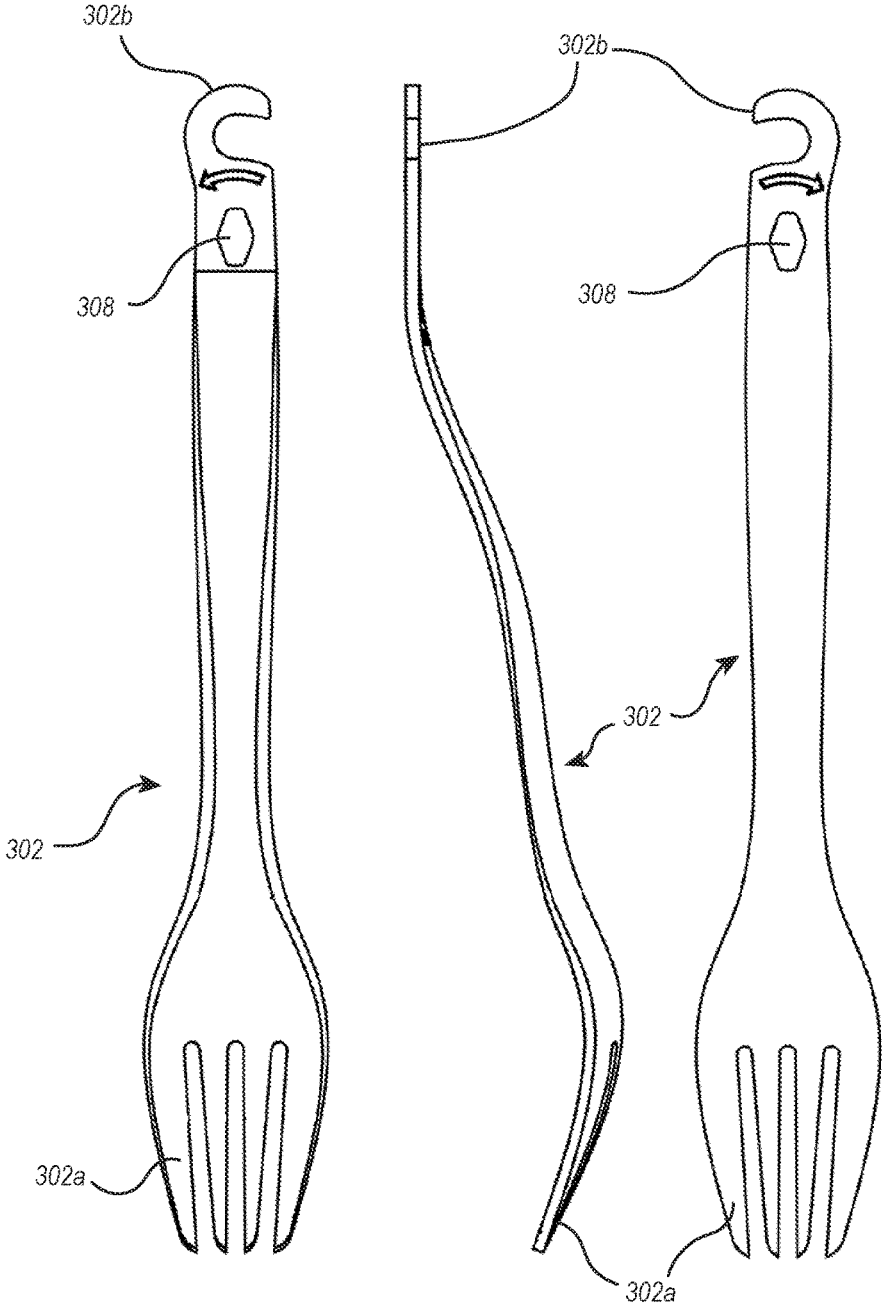
FIG. 10 discloses a configuration of a fork portion of a multi-use tool.
Figure 11:
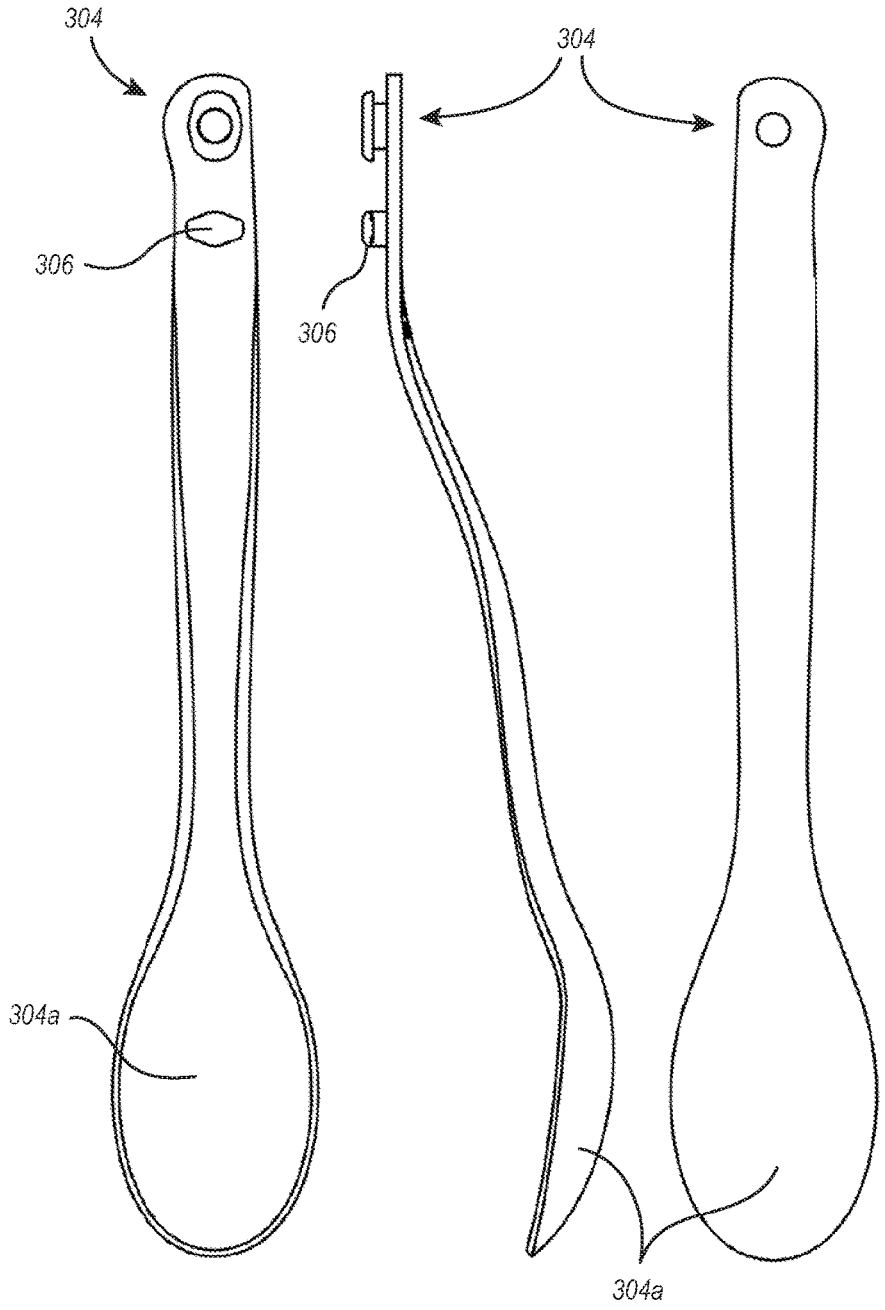
FIG. 11 discloses a configuration of a fork portion of a multi-use tool.

With particular reference now to FIGS. 9-11, further details are provided concerning some example embodiments of the invention, one of which is denoted generally at 300.

Except as noted below, the tool 300 can be similar, or identical, to the example embodiment disclosed in FIGS. 1-8. Thus, only selected differences between the embodiments are addressed in the following discussion.

As shown in FIGS. 9-11, the tool 300 can include first and second portions 302 and 304, respectively, that are releasably connectible to each other in part by way of a pin 306 of the second portion 304 that is configured to be removably received in a pivot hole 308 of the first portion 302. In this example configuration, the pin 306 has an elongated head configuration, and the pivot hole 308 likewise has a correspondingly elongated form. Consequently, the pin 306 can readily pass through the pivot hole 308 when the portions 302 and 304 are oriented as shown in the left-hand side of the uppermost view of FIG. 9. In contrast, the pin 306 is prevented from passing through the pivot hole 308 when the portions 302 and 304 are oriented as shown in the right-hand side of the uppermost view of FIG. 9. The middle portion of the uppermost view of FIG. 9 illustrates a transitional configuration between the two aforementioned configurations of the pin 306 and pivot hole 308. The other views of FIG. 9 show the portions 302 and 304 in a nested configuration (far left side of FIG. 9), and in a tong configuration.

Finally, and as indicated in the example of FIG. 9 (leftmost view), the portion 302 can be nested above the portion 304. However, in some alternative embodiments, the portion 302 is nested below the portion 304.

With reference now to FIG. 10, the portion 302, which can be in the form of a fork for example, is disclosed in further detail. As indicated, the portion 302 can include a fork with multiple tines 302*a*. Part, or all, of each of the tines 302*a*, such as the front side and/or the back side, can be polished. In other embodiments, the tines 302*a* need not have a polished finish. Where provided, a polished finish on the tines 302*a* can be more pleasing to the user, and may help to facilitate cleaning of the tines 302*a*. As further disclosed in FIG. 10, the portion 302 can include a hook 302*b*, designated as a 'bail hook' in that Figure, as some embodiments of the hook 302*b* can be used to engage a bail, or handle, of an item such as a lid of a pot. In addition to facilitating the releasable connection of the portion 302 to the portion 304, the hook 302*b* may have separate utility, such as for lifting items such as hot lids. Finally, the length of the portion 302 can be selected, for example, to be sufficiently long to reach the bottom of a meal packet. Thus, in one example embodiment, the portion 302 may have an overall length of about 8.5 inches, although longer, or shorter, portions 302 can be employed in other embodiments, and the scope of the invention is not limited to portions 302 of this example dimension.

Turning finally to FIG. 11, the portion 304, which can be in the form of a spoon for example, is disclosed in further detail. As indicated, the portion 304 can include a spoon portion 304*a*. Part, or all, of each of the spoon portion 304*a*, such as the front side and/or the back side, can be polished. In other embodiments, the spoon portion 304*a* need not have a polished finish. Where provided, a polished finish on the spoon portion 304*a* can be more pleasing to the user, and may help to facilitate cleaning of the spoon portion 304*a*. The spoon portion 304*a* can be any suitable size. In some example embodiments, the spoon portion 304*a* is sized to hold about 1 tablespoon (tbsp.) of material. Larger, or smaller, spoon portions 304*a* can be employed in other embodiments. For example, in one embodiment, the spoon portion 304*a* is sized to hold about a teaspoon (tsp.) of material. Finally, the length of the portion 304 can be selected, for example, to be sufficiently long to reach the bottom of a meal packet. Thus, in one example embodiment, the portion 304 may have an overall length of about 8.5 inches, although longer, or shorter, portions 304 can be employed in other embodiments, and the scope of the invention is not limited to portions 304 of this example dimension.

Figure 12:
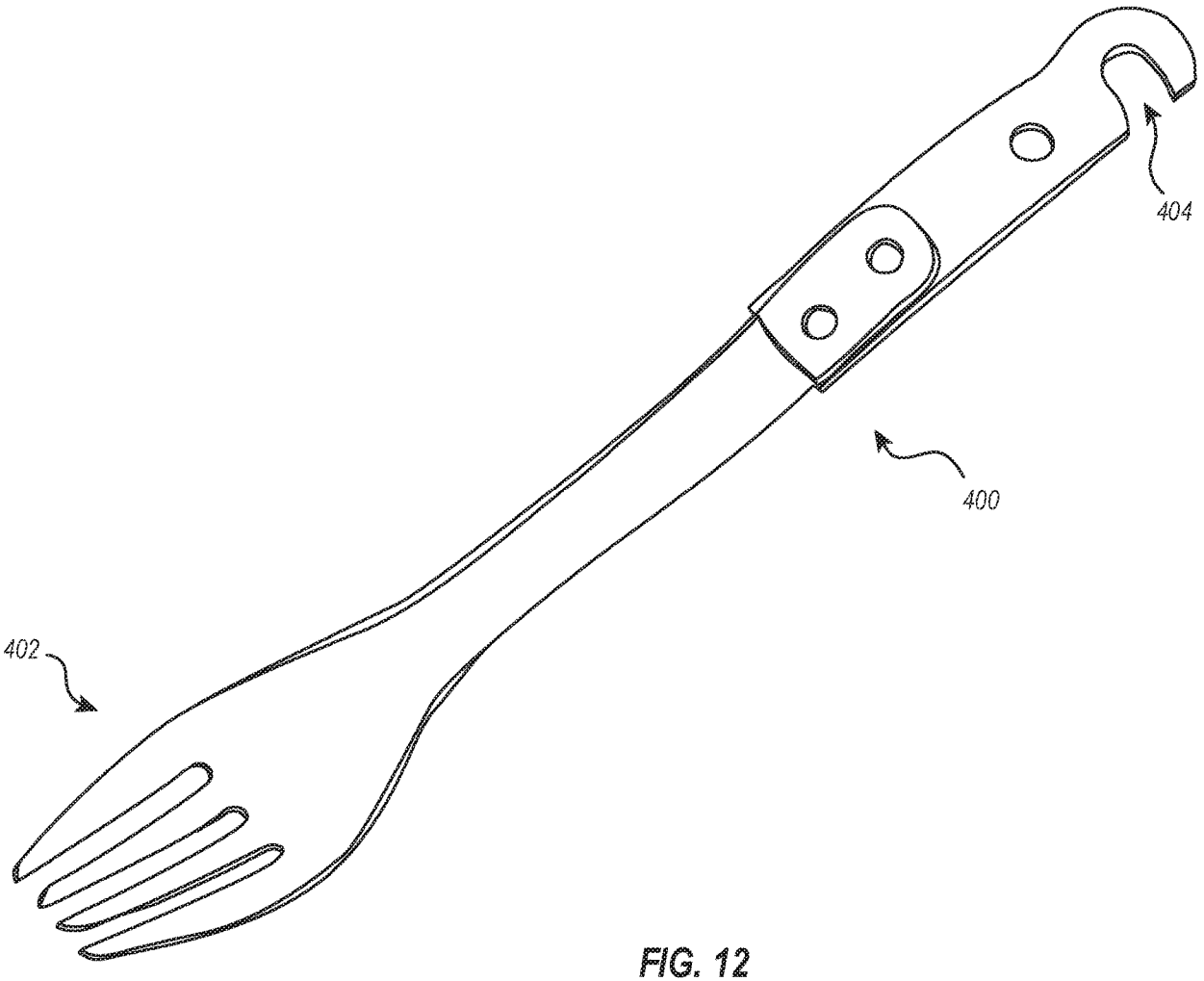
FIG. 12 discloses an alternative embodiment of a multi-use tool.

With reference finally to FIG. 12, details are provided concerning an alternate embodiment of a multi-use tool, one half of which is designated generally at 400. While not specifically illustrated in FIG. 12, it will be appreciated that a spoon portion, and/or other portion(s), of a multi-use tool could be constructed in generally the same fashion as the fork portion indicated in FIG. 12.

This particular embodiment has a composite construction. Thus, for example, the majority of the utensil 400, including the eating end 402, will be made from metal such as stainless steel and/or titanium. The end of the utensil, including a portion of a connecting mechanism, such as a hook 404 for example, can be overmolded from nylon and/or other suitable plastic(s). This approach may be advantageous for various reasons. First, the metals used to make at least some embodiments of the spoon and/or fork portions lack the capability of being spring-tempered. In fact, some of such metals may not be able to be tempered at all, and so do not possess the necessary elastic resilience to function as tongs on their own. Thus, the overmolded nylon will provide the resilience that is not present in such metals. Second, the connection mechanism may be relatively easier to manufacture from molded nylon, or other plastic(s), than from metal. Finally, the molded nylon can provide a degree of insulation for the user if the metal portion were to become uncomfortably hot during use.

Although this disclosure has been described in terms of certain embodiments, other embodiments apparent to those of ordinary skill in the art are also within the scope of this disclosure. Accordingly, the scope of the disclosure is intended to be defined only by the claims which follow.

What is claimed is:

1. A multi-use tool, comprising:

a first portion that includes a first utensil;

a second portion that includes a second utensil; and a connection mechanism that enables the first utensil and second utensil to be releasably attached to each other in a first configuration in which the first utensil and second utensil collectively form a set of tongs, wherein the connection mechanism includes a hook that is an element of the first portion and the connection mechanism also includes a locking pin that is an element of the second portion, and the hook and locking pin are configured to releasably engage each other.

2. The multi-use tool as recited in claim 1, wherein the connection mechanism enables the first utensil and second utensil to be releasably attached to each other in a second configuration that is different from the first configuration.

3. The multi-use tool as recited in claim 2, wherein the second configuration is a configuration in which respective portions of the first utensil and second utensil are arranged in a nested relation with each other.

4. The multi-use tool as recited in claim 1, wherein at least part of the connection mechanism is implemented as part of a plastic overmolded portion that includes a first engaging element, and the connection mechanism includes a second engaging element configured to releasably engage the first engaging element.

5. The multi-use tool as recited in claim 1, wherein the connection mechanism further comprises a pin configured and arranged so that the first portion and the second portion are rotatable relative to each other.

6. The multi-use tool as recited in claim 1, wherein when the hook and locking pin are fully engaged with each other, one of the portions acts as a spring to exert a retention force that holds the hook and locking pin in position relative to each other.

7. The multi-use tool as recited in claim 1, wherein one or both of the first portion and the second portion includes a bend.

8. The multi-use tool as recited in claim 7, wherein each of the first portion and the second portion portions includes a respective bend such that in one configuration of the multi-use tool, respective parts of the first and second portions are spaced apart from each other.

9. A multi-use tool, comprising:

a first utensil in the form of a fork;

a second utensil in the form of a spoon; and a connection mechanism that enables the fork and the spoon to be releasably attached to each other in a first configuration in which the fork and the spoon collectively form a set of tongs, wherein the connection mechanism includes a hook near one end of the fork or spoon, and the connection mechanism also includes a locking pin near one end of the other of the fork and spoon.

10. The multi-use tool as recited in claim 9, wherein the connection mechanism enables the fork and spoon to be releasably attached to each other in a second configuration that is different from the first configuration.

11. The multi-use tool as recited in claim 10, wherein the second configuration is a configuration in which respective portions of the fork and spoon are arranged in a nested relation with each other.

12. The multi-use tool as recited in claim 9, wherein one of the first utensil and the second utensil includes an integral pin with an elongated head, and the other of the first utensil and the second utensil defines an elongated hole configured to receive the elongated head of the pin, and the pin is configured and arranged so that the fork and the spoon are rotatable relative to each other.

13. The multi-use tool as recited in claim 9, wherein when the hook and locking pin are fully engaged with each other, the fork or spoon acts as a spring to exert a retention force that holds the hook and locking pin in position relative to each other.

14. The multi-use tool as recited in claim 9, wherein one or both of the first utensil and the second utensil includes a bend.

15. The multi-use tool as recited in claim 9, wherein each of the fork and spoon includes a respective bend such that in one configuration of the multi-use tool, respective parts of the fork and spoon are spaced apart from each other in an undeformed state.

16. The multi-use tool as recited in claim 9, wherein one or more surfaces of the fork and/or spoon have polished finish.

17. The multi-use tool as recited in claim 9, wherein the fork and spoon are made of titanium or stainless steel.

18. The multi-use tool as recited in claim 9, wherein the connection mechanism is a fastenerless mechanism.

* * * * *